United States Patent [19]

Hoyer

[11] 4,091,869

[45] May 30, 1978

[54] IN SITU PROCESS FOR RECOVERY OF CARBONACEOUS MATERIALS FROM SUBTERRANEAN DEPOSITS

[75] Inventor: Wilmer A. Hoyer, Houston, Tex.

[73] Assignee: Exxon Production Research Company, Houston, Tex.

[21] Appl. No.: 720,914

[22] Filed: Sep. 7, 1976

[51] Int. Cl.[2] ..... E21B 43/24; E21B 43/26

[52] U.S. Cl. ..... 166/259; 166/281; 166/303

[58] Field of Search ..... 166/247, 256, 258, 259, 166/251, 281, 303; 299/2

[56] References Cited

U.S. PATENT DOCUMENTS

| | | | |
|---|---|---|---|
| 1,913,395 | 6/1933 | Karrick | 299/2 |
| 3,113,620 | 12/1963 | Hemminger | 166/259 X |
| 3,198,249 | 8/1965 | Willman | 166/251 |
| 3,342,257 | 9/1967 | Jacobs et al. | 166/259 UX |
| 3,465,818 | 9/1969 | Dixon | 166/247 |
| 3,465,819 | 9/1969 | Dixon | 166/247 |
| 3,537,529 | 11/1970 | Timmerman | 166/281 X |
| 3,537,753 | 11/1970 | Arendt | 299/2 |
| 3,661,423 | 5/1972 | Garret | 299/2 |
| 3,882,941 | 5/1975 | Pelofsky | 166/303 |
| 3,980,339 | 9/1976 | Heald et al. | 299/2 |
| 4,015,664 | 4/1977 | Acheson et al. | 166/259 |

*Primary Examiner*—Stephen J. Novosad
*Assistant Examiner*—George A. Suchfield
*Attorney, Agent, or Firm*—Gary D. Lawson; Michael A. Nametz

[57] ABSTRACT

A method is disclosed for recovering carbonaceous material from a subterranean deposit such as oil shale. A first zone of the subterranean deposit is heated to liquefy and vaporize carbonaceous materials contained therein. A substantial portion of the carbonaceous materials are removed from this first zone. Thereafter a second zone of the deposit is rubblized such that material of the second zone occupies a portion of the space occupied by the first zone. The second zone is then heated and carbonaceous materials are removed therefrom.

7 Claims, 2 Drawing Figures

IN SITU PROCESS FOR RECOVERY OF CARBONACEOUS MATERIALS FROM SUBTERRANEAN DEPOSITS

BACKGROUND OF THE INVENTION

1. Field of the Invention

This invention concerns a method of recovering products from a subterranean deposit, and more specifically to an in situ retorting method and system for recovering carbonaceous materials from a subterranean deposit.

2. Description of the Prior Art

As the world's petroleum and gas reserves are depleted, more attention is being directed to the world's oil shale deposits. Oil shale is a highly consolidated rock composed of a complex mixture of organic and inorganic constituents. The organic portion is an amorphous organic solid (called kerogen) which will decompose or pyrolyze when heated to temperatures above 500° F to provide fluid hydrocarbons commonly termed "shale oil."

Considerable research has been conducted to develop economic methods of recovering hydrocarbon products from oil shale deposits. Methods suggested can generally be divided into two categories: surface retorting and in situ retorting.

Surface retorting involves mining the oil shale, transporting it to the surface, crushing the shale, and then forcing it through a surface retort to extract the recoverable hydrocarbon products. Although surface retorting processes have been investigated for many years, problems inherent in this process has deterred widespread commercial application. Typically, mining is expensive and there are environmental problems associated with removing the shale and with disposing the spent shale.

In situ retorting processes involve heating the shale in situ to pyrolization temperature either by in situ combustion or by passing externally heated gas through the shale and removing the gas and liquid products to the surface through shafts or wells. In situ processes may significantly reduce environmental problems such as surface disfigurement caused by surface mining and the need for disposing spent oil shale from surface retorts. It also may be more economic than mining in deeper deposits and in lower grade oil shale.

A prerequisite to in situ retorting is creating adequate permeability in the shale deposit to provide passages for the retorting fluid, good heat transfer to the shale, and paths for the retorted values. Since oil shale deposits typically do not have sufficient permeability to carry out in situ retorting processes, methods have been proposed to create this permeability. One such method is explosive, hydraulic, or electrical fracturing. Fracturing, however, is generally not as economic and efficient as certain other fragmenting techniques since it is generally difficult to fragment the entire shale deposit.

Another method of increasing oil shale permeability is to use nuclear explosions to create a rubble-filled chimney. A nuclear blast produces a cavity mainly by displacing the surface upward. As the rock condenses to a liquid and begins to collect at the bottom of the cavity the decrease in pressure causes the roof to collapse. Shale falls into the cavity creating a column of broken oil shale, generally called a rubble pile. Unfortunately, this technique is applicable only to deep formations and there are potential problems associated with radioactivity and damage and inconvenience to residents caused by ground motion.

A more recent method of increasing shale permeability is a modified in situ technique in which a portion of the oil shale at the base of the oil shale is excavated to create a void space. The remaining exposed shale is then allowed to collapse by itself or with the aid of explosives. In either case, the deposit to be retorted is expanded into a larger volume than originally occupied. The resulting rubble pile is then retorted. An example of this method is described in U.S. Pat. No. 3,661,423, issued May 9, 1972, to Garrett. Unfortunately, these "mining and collapse" methods also suffer drawbacks. One difficulty is that the shale oil to be mined may not be rich enough to justify mining and surface treatment. Another problem is that it is often difficult to mine oil shale and special precautions are often necessary to ensure safety of the miners. Still another problem is that substantial amounts of shale are left undisturbed in order to form walls which define and separate the rubble piles. Due to the relatively impermeable nature of oil shale, only a small portion of these solid walls will be retorted, therefore, significant portions of the hydrocarbons in these walls may not be recovered.

SUMMARY OF THE INVENTION

In this invention a method is described for enhancing recovery of carbonaceous materials from subterranean hydrocarbon-containing deposits. Initially, a first rubble pile in a carbonaceous deposit is retorted to liquefy and vaporize carbonaceous materials contained therein. After a substantial portion of the carbonaceous materials are removed from this first rubble pile a second rubble pile contiguous to the first pile is formed such that a portion of the second rubble pile occupies a portion of the space occupied by the first rubble pile. This second rubble pile is then retorted and the carbonaceous material removed therefrom. This process may be progressively repeated to systematically remove carbonaceous material from other portions of the subterranean deposit.

In one embodiment of this invention, initially from about 5 to about 30% by volume of the shale in a first zone of an oil shale deposit zone is mined to create a void or cavity. The remaining shale is then blasted into the void space to create a rubble pile. Communication is established with the upper level of the rubblized deposit and a suitable high-temperature, gaseous medium is introduced which will cause the rubble pile to release the carbonaceous materials as a liquid and/or vapor by downward flow of the gaseous medium. The released carbonaceous materials are recovered from the base of the rubble pile. A second zone of the deposit contiguous to the first rubble pile is then fragmented and expanded by detonating an explosive charge such that the resulting rubble pile occupies a portion of the first zone. The carbonaceous material in the second rubble pile is retorted and removed in a manner similar to the shale oil recovery from the first rubble pile.

DESCRIPTION OF THE PREFERRED EMBODIMENTS

While the practice of this invention is generally applicable to the recovery of products from a subterranean deposit containing carbonaceous material, its practice may be conveniently illustrated in terms of recovering hydrocarbon products from oil shale.

Figure 1:
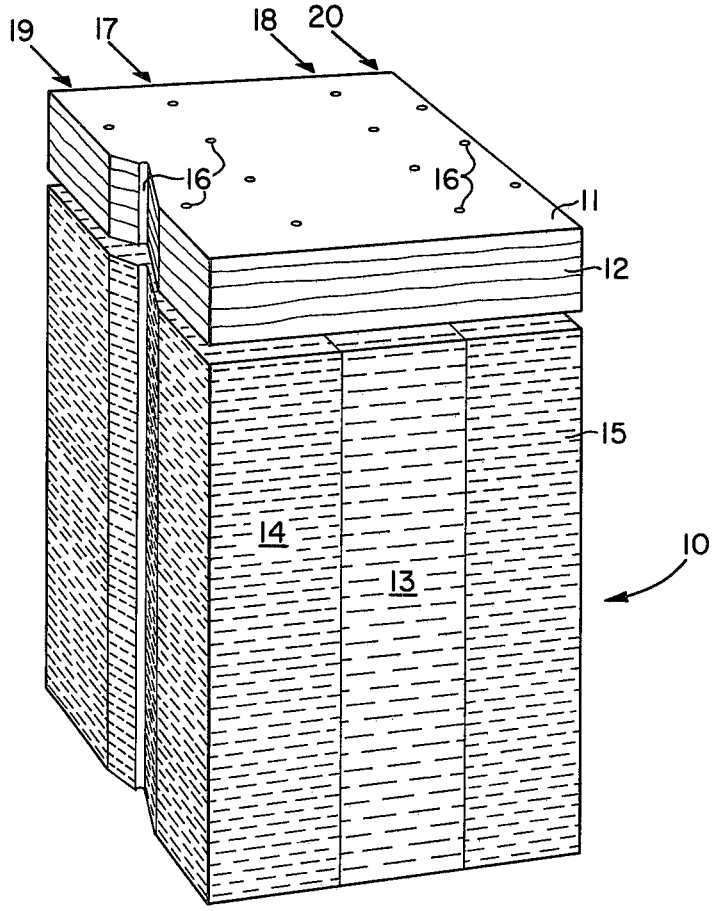
FIG. 1 illustrates a perspective view of a region of an oil shale deposit lying below the surface of the earth during one stage of development in accordance with this invention.

With reference to FIG. 1, there is illustrated a region 10 of an oil shale deposit lying below the earth's surface 11 during development in accordance with this invention. The shale deposit lies from about 200 to 3000 feet below the surface 11. The thickness of the oil shale deposit can vary, but preferably ranges from 50 to 1000 feet. The minimum depth of the ground cover 12 is that necessary to ensure that the overburden does not collapse. The maximum depth is limited only by economic considerations involved in penetrating deep-lying formations with drilling equipment. Preferably, the oil shale deposit contains enough kerogen to provide a Fischer assay richness of at least 10 gallons per ton of rock. Region 10 may range in size from 50 to 500 feet on a side and may be square, rectangular (as illustrated), or may take some other configuration. The region geometry will depend on the overall size of the deposit, the quality of the oil shale and the means used for fragmenting the oil shale rock.

For purposes of illustrating the practice of this invention, region 10 is divided into three zones 13, 14 and 15. Preferably, these zones have approximately the same geometry.

Initially, the shale in zone 13 is rubblized by explosives or similar known techniques to create a rubble pile. The rubble pile may be created, for example, by first removing the shale from the lower portion of the zone by mining to create a cavity or void and then expanding the overlying deposit, preferably explosively, to form a mass of rubblized shale having a void volume approximately equal to the volume of the cavity. The volume of the deposit removed can be selected in accordance with well-known principles. For oil shale, this undercut is usually expressed somewhere between 5 and 35 percent of zone 13 with optimum values varying with the degree of permeability and porosity to be achieved.

To retort this rubble pile, different embodiments of heating steps can be utilized. In one embodiment, communication (not shown) is established with the ceiling of the expanded carbonaceous deposit and a hot gaseous media, which will liquefy or vaporize the hydrocarbon material, is forced downwardly through the rubblized shale. The gaseous media will normally be recovered for recycling. The gas and liquid products which seep downwardly through the shale and are collected in a sump at the bottom of the rubble pile, removed through an outlet well (not shown) and lifted to the surface by conventional production techniques.

The gaseous media, generally referred to as the "retorting gas," may be air, oxygen, recycled flue gases, inert gas or any combination of the above. These gases may be heated on the surface prior to injection into the deposit and they may be supplied to fuel and/or support in situ combustion within the rubblized deposit. Both in situ combustion and hot inert gas retorting processes are well known and no further discussion is therefore considered necessary.

After about at least 60% and preferably at least 80% of the organic matter in the rubble pile has been recovered, shale in zones 14 and 15 is then explosively rubblized.

This rubblization may be accomplished by loading explosive charges in a multiplicity of blasting holes 16 which are drilled through the overburden to the bottom of zones 14 and 15. These blasting holes may be arranged in any suitable manner but are typically arranged in rows as shown in FIG. 1. Although zones 14 and 15 are each traversed by seven boreholes forming two rows in each zone, it should be understood that more or less rows and boreholes can be provided in each zone without departing from the present invention. The blasting holes of rows 17 and 18 may be drilled near the face of zone 13, and blasting holes of rows 19 and 20 may be formed near the other side of zones 14 and 15. The blasting holes are charged with suitable explosives in an amount sufficient to obtain the desired particle size distribution and permeability upon blasting. A column of water, sand fill or a cement plug is then placed in the holes to confine the explosive forces to the shale deposit.

Figure 2:
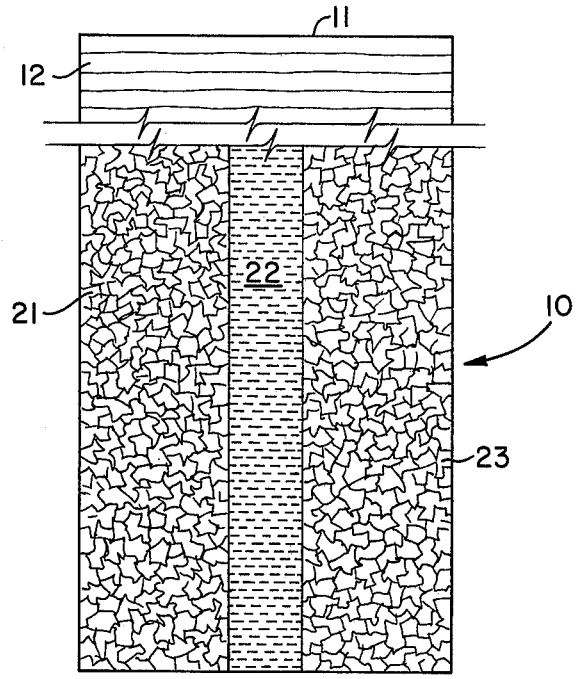
FIG. 2 is a sectional view of the shale region illustrated in FIG. 1 during another stage of development in accordance with this invention.

The explosive charges in the holes are detonated in a laterally progressing time sequence with the charges closest to zone 13 being detonated first. For example, millisecond delays may be attached to permit instantaneous explosion of rows 17 and 18 followed by a 3 millisecond delay in detonation of rows 19 and 20. The resulting expanding shock front experiences least resistance in the direction of zone 13 so that rock is blasted into zone 13. The compressive stress induced by the detonation almost immediately compacts the spent shale to create a compacted spent shale zone 22 as shown in FIG. 2. These explosives thus fragment and expand the shale in zones 14 and 15 to form rubble piles 21 and 23 which occupy a portion of the zone 13 space.

Rubble piles 21 and 23 may then be retorted in a conventional manner. After rubble piles 21 and 23 have been suitably retorted, unrubblized shale in zones (not shown) bordering retorted rubble piles 21 and 23 may then be blasted into previously retorted zones. It can thus be appreciated that the steps of retorting shale and expanding contiguous unrubblized shale rock into the retorted zones may be progressively repeated to systematically recover shale oil from the shale deposit without leaving any unretorted shale between retorting zones.

Explosives suitable for creating rubblized zones in subsurface oil shale formations are well-known in the art. Due to space limitations inherent in detonating explosives in a borehole, explosives having a high energy yield for their size are especially preferred. Suitable explosives may include nitrile cellulose, nitroglycerine, trinitriletoluene (TNT), metalized ammonium nitrate and rocket type fuels altered to behave as liquid explosives. In addition to chemical explosives, nuclear explosives such as an atomic or a hydrogen bomb may also be used.

This invention may be practiced in any carbonaceous deposit wherein in situ retorting processes provide sufficient void space for rubblizing adjacent portions of the deposit. Examples of such deposits include oil shale, bituminous coal and lignite.

The practice of this invention is based on the concept that removal of carbonaceous materials from a carbonaceous deposit provides sufficient room for expanding and rubblizing contiguous carbonaceous zones of the deposit. Unretorted oil shale, for example, is normally a nonporous rock, however, after the oil shale is heated and oil is removed voids are left in the essentially unaltered rock. It is well known that the organic matter in oil shale can comprise a substantial portion of the original rock volume. By way of illustration, shale yielding 30 gallons of oil per ton of rock may contain organic matter occupying about 35 volume percent of the rock. When the organic matter decomposes under normal retorting procedures, about 80 weight percent of it is driven off as oil, water and noncondensable gases. This leaves behind a high-carbon coke material which occupies only about 10 percent of the volume the organic material originally occupied so that about 90 percent of the original organic volume is void space.

While gravitational compaction may create cavities near the top of the spent shale zone, a substantial portion of the void space will normally be evenly distributed in the spent shale. Since spent shale is largely incohesive and mobile under localized pressure or vibration, it can be compacted by detonating explosive charges. These charges may be placed near the spent shale zone as previously described or they may be located in the spent shale zone itself. In either case, the compaction not only provides room for expansion of adjacent shale rock but it also reduces the spent shales's permeability to fluid flow.

The void spaces resulting from removal of organic matter from the shale rock provides interconnecting passageways for fluids in the previously impermeable shale. This permeability must be substantially reduced in order to effectively retort bordering rubble piles since the very nature of an in situ process requires that the retort chamber be essentially fluid tight so that retort gases do not escape. In the practice of this invention, compacted spent shale zone 22 should form a barrier with sufficiently low permeability to fluid flow to prevent gas leakage either into or out of a retorting chamber. However, sometimes it may be necessary to introduce sealing fluids into the spent shale to further reduce gas permeability. This may be accomplished, for example, by introducing into the spent shale aqueous solutions containing various additives such as resins, silicates, hydrated oxides or the like either before or after compacting the shale.

With reference to FIGS. 1 and 2, the following example will serve to illustrate this invention by describing the development of a small region 10 of an oil shale deposit which may be performed in successive stages to recover shale oil in other regions of the deposit.

The shale deposit lies below 300 feet of overburden and has a thickness of 120 feet. The shale contains enough kerogen to provide a Fischer assay richness of 30 gallons of hydrocarbons per ton of shale rock. Region 10 has a horizontal dimension of 120 by 40 feet and has a vertical dimension of 120 feet. Zones 13, 14 and 15 are each 40 feet square in horizontal dimension and 120 feet in depth.

Initially, the bottom 24 feet of zone 13 is removed by conventional mining techniques through access drifts (not shown in the Figures). The mined material is removed to the surface for surface retorting. Drill holes are placed in the remaining zone 13 shale in a pattern which will obtain the desired particle size distribution and permeability. Explosive charges are loaded in these holes and the charges are detonated progressively from the bottom up.

Following the explosive caving, both product recovering and air feeding facilities are installed. Gas flow through the retort is initiated by forcing compressed air with or without flue gas through a central air tunnel, through the retort and through heat and product recovery systems. If preheating is not sufficient, start-up fuel is injected into the inlet air and ignited. The resultant flue gases heat the top of the bed and initiate the retorting process. When the top shale reaches 300° F to 400° F, it will sustain combustion without the start-up fuel. Retorting proceeds as the heat front descends through the bed causing decomposition of the kerogen to yield shale oil which is then carried down through the bed with the moving gases. Residual carbon left on the shale is burned with incoming oxygen, thus providing the heat for continued retorting. Retorting is completed when the bottom of the bed reaches about 900° F, usually with a total gas flow of less than 20,000 SCF/ton of oil shale. The amount of air necessary for a heat balance will usually be less than 10,000 SCF/ton depending upon the efficiency of heat recovery. Gas velocity during retort is 1 to 4 SCF/min./ft.$^2$ retort cross-sectional area. The organic recovery from zone 13 should be about 90% of the organic matter in the zone 13 shale rock.

After zone 13 has been retorted, zones 14 and 15 are rubblized by detonating explosives. As shown in FIG. 1, seven vertical boreholes are drilled which extend to the bottom of zones 14 and 15. Four of these boreholes are located about 5 feet from zone 13 and are spaced about 10 feet apart. The boreholes have a diameter of about 4 inches. Three of the boreholes are about 30 feet from zone 13, and spaced about 13 feet apart. These three holes have a diameter of about 16 inches. Approximately 330 pounds of aluminized ammonium nitrate are loaded into each 4 inch diameter hole and about 890 pounds of aluminized ammonium nitrate are loaded into each 16 inch diameter hole. Sand is then introduced into each hole to confine the explosive blasts to the deposit. The explosives in the holes closest to zone 13 are simultaneously detonated to compact spent shale in zone 13. After about 3 milliseconds the explosives farther away from zone 13 are simultaneously detonated to further compact zone 13 and to rubblize zones 14 and 15.

Following rubblization of the shale in zones 14 and 15, both product recovery and air feeding facilities are installed and the rubble piles are retorted in the same manner as described for retorting the shale in zone 13.

While the foregoing description has been directed toward an embodiment of the invention which is considered to constitute the best mode of carrying out the invention, it will be recognized that numerous modifications, additions, and subtractions may be made to the illustrated embodiment without departing from the spirit or scope of this invention.

What is claimed is:

1. A method for recovering carbonaceous material from a subterranean deposit which comprises:

(a) rubblizing a first portion of the deposit;

(b) retorting the resulting rubblized first portion to recover carbonaceous material therefrom and thereby provide void space therein;

(c) providing a first multiplicity of vertical blasting holes in the deposit laterally adjacent to the first portion;

(d) providing a second multiplicity of vertical blasting holes in the deposit farther from said first portion than the first multiplicity of blasting holes, the first and second multiplicities of blasting holes substantially defining a second portion of the deposit contiguous to the first portion;

(e) loading each blasting hole with an explosive charge, the primary purpose of the explosive charges in the first multiplicity of blasting holes being to compact the retorted permeable first portion of the deposit and the primary purpose of the explosive charges in the second multiplicity of blasting holes being to rubblize the second portion of the deposit;

(f) detonating the explosive charges in the first multiplicity of blasting holes such that the first portion is laterally compacted to substantially reduce the void space therein, thereby reducing the first portion's permeability to fluid flow;

(g) detonating the explosive charges in the second multiplicity of blasting holes thereby laterally rubblizing the second portion of the deposit and further compacting the first portion; and (h) retorting the second portion to recover carbonaceous material therefrom.

2. The method as defined in claim 1 wherein said subterranean deposit is oil shale.

3. The method as defined in claim 1 wherein said portions are retorted by in situ combustion.

4. The method as defined in claim 1 wherein said portions are retorted by a gaseous media selected from the group consisting of hot gases and steam.

5. The method as defined in claim 1 further comprising introducing a fluid into said first portion after recovering carbonaceous material therefrom, said fluid operating to further reduce said first portion's permeability to fluid flow.

6. The method of claim 1 wherein the second portion comprises two zones of the deposit which are separated by the first portion and fluid flow between the zones is subtantially prevented by the first portion after compacting by detonating the explosive charges.

7. The method of claim 1 wherein a delay in the order of milliseconds is provided between detonation of explosive charges in the first and second multiplicities of blasting holes.

* * * * *